United States Patent [19]

Fukuda et al.

[11] Patent Number: 4,602,976

[45] Date of Patent: Jul. 29, 1986

[54] BINDING MACHINE

[75] Inventors: Michio Fukuda, Osaka; Shiro Kitamura, Kanazawa; Hiroshi Kagei, Yokkaichi, all of Japan

[73] Assignees: Sumitomo Electric Industries, Ltd., Osaka; Tokai Electric Wire Company Limited, Yokkaichi, both of Japan

[21] Appl. No.: 709,536

[22] Filed: Mar. 8, 1985

[30] Foreign Application Priority Data

Mar. 17, 1984 [JP] Japan ..... 59-38739[U]

[51] Int. Cl.[4] ..... B65H 81/06; B65B 27/10

[52] U.S. Cl. ..... 156/433; 156/468; 156/486; 156/522

[58] Field of Search ..... 156/433, 391, 392, 443, 156/487, 486, 468, 517, 522, 526, 530, 579, 577, 53, 166, 441, 468; 140/57, 93 A, 93.2; 100/8, 10, 15, 27

[56] References Cited

U.S. PATENT DOCUMENTS

| | | | |
|---|---|---|---|
| 2,834,499 | 5/1958 | Semkow | 156/486 |
| 3,242,850 | 3/1966 | Adams et al. | 156/522 |
| 3,245,860 | 4/1966 | Aurich et al. | 156/517 |
| 3,414,451 | 12/1968 | Seida | 156/486 |
| 3,547,737 | 12/1970 | Vei | 156/486 |

FOREIGN PATENT DOCUMENTS

| | | | |
|---|---|---|---|
| 66467 | 5/1980 | Japan | 156/468 |

*Primary Examiner*—Michael Ball

*Attorney, Agent, or Firm*—Harness, Dickey & Pierce

[57] ABSTRACT

Disclosed is a binding machine for binding a bundle of linear members such as electric wires. The binding machine has a drum-like rotary member mounted for rotation in one direction. The rotary member has a notch extending radially inwardly to the area around the center thereof such as to provide a substantially U-shaped work holding portion. The rotary member further has a tape guiding portion extending radially outwardly therefrom and provided with a pair of guide pins which are spaced in the radial direction of the rotary member. A cutting blade is disposed between two concentric circles along which the guide pins move when the rotary member rotates. The cutting blade is directed counter to the direction of rotation of the rotary member. A tape roll holding means is mounted on the frame and adapted for holding a tape roll such that the leading end of the tape extracted therefrom is lead to a position in front of the radial opening of the tape holding means. When the rotary member rotates with a work received in the work holding means and partially wound by the tape extracted from the tape roll, the tape is further extracted, cut and wound around the work thus accomplishing the building.

3 Claims, 6 Drawing Figures

BINDING MACHINE

BACKGROUND OF THE INVENTION

The present invention relates to a binding machine for binding a bundle of linear materials such as electric wires, wire rods and so forth by winding an adhesive tape around such a bundle.

Binding machines of the kind described developed and proposed up to now can be sorted into two types: namely, a first type in which a tape roll revolves around the bundle such as to wind a tape around the bundle, and a second type in which a tape is extracted from a stationary tape roll and cut into pieces of a predetermined length, the tape pieces then being wound around the bundle as it is rotated by a rotary holder.

The binding machine of the first type is inevitably large in size and complicated in construction due to the necessity for the provision of a mechanism for revolving the tape roll around the bundle. The binding machine of the second type encounters the same problems because the tape extracting mechanism, the tape cutting mechanism and the taping mechanism, the last of which includes the bundle rotating means, are all provided independently.

SUMMARY OF THE INVENTION

Accordingly, it is a primary object of the invention to provide a binding machine in which one binding operation cycle which incorporates the tape extraction, tape cutting and the tape winding is completed by a single action of a taping unit, thereby overcoming the above-described problems of the prior arts.

To this end, according to the invention, there is provided a binding machine comprising: a drum-like rotary member mounted on a frame for rotation in at least one direction, the rotary member having a notch formed over a portion of the circumference thereof and extending radially inwardly to the area around the center thereof, such as to provide a substantially U-shaped work holding means, the rotary member further having a tape guiding portion extending radially outwardly therefrom at a position spaced from the work holding means, the tape guiding portion being provided with a pair of guide pins one of which is located in the rapidly outer extremity of the tape guiding portion while the other is located near the radially inner end of the tape guiding portion; a cutting means mounted on the frame having a cutting edge disposed between two concentric circles along which the guide pins move when the rotary member rotates in the direction counter to the direction of rotation of the rotary member; and a tape roll holding means mounted on the frame and adapted for holding a tape roll such that the leading end of the tape extracted therefrom is lead to a position in front of the radial opening of the tape holding means; whereby, when the rotary member rotates with a work received in the work holding means and partially wound by the tape extracted from the tape roll, the tape is further extracted, cut and wound around the work, thus accomplishing the binding.

The above and other objects, features and advantages of the invention will become clear from the following description of the preferred embodiment when the same is read in conjunction with the accompanying drawings.

DESCRIPTION OF THE PREFERRED EMBODIMENT

Figure 1:
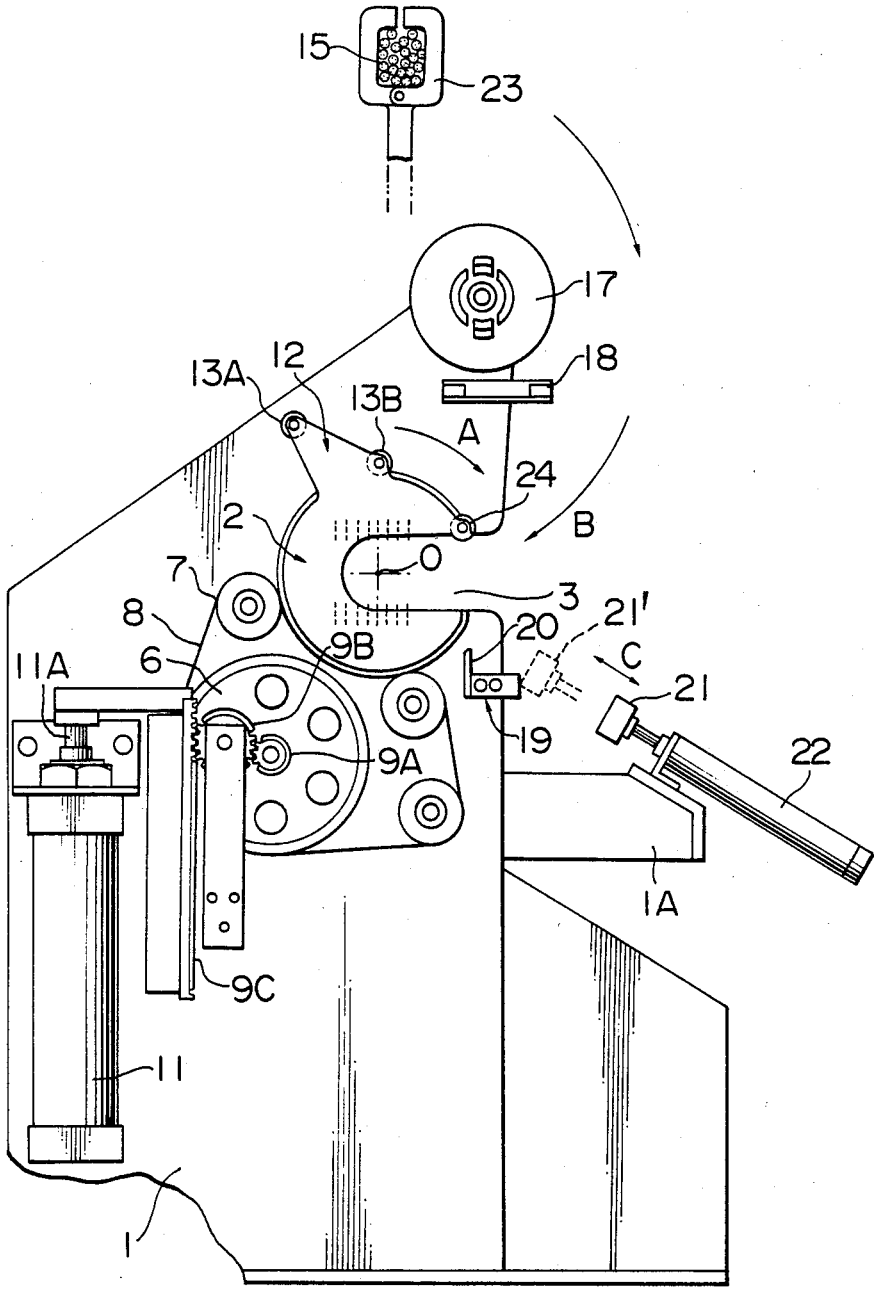
FIG. 1 is a front elevational view of an embodiment of the binding machine in accordance with the invention.
Figure 2:
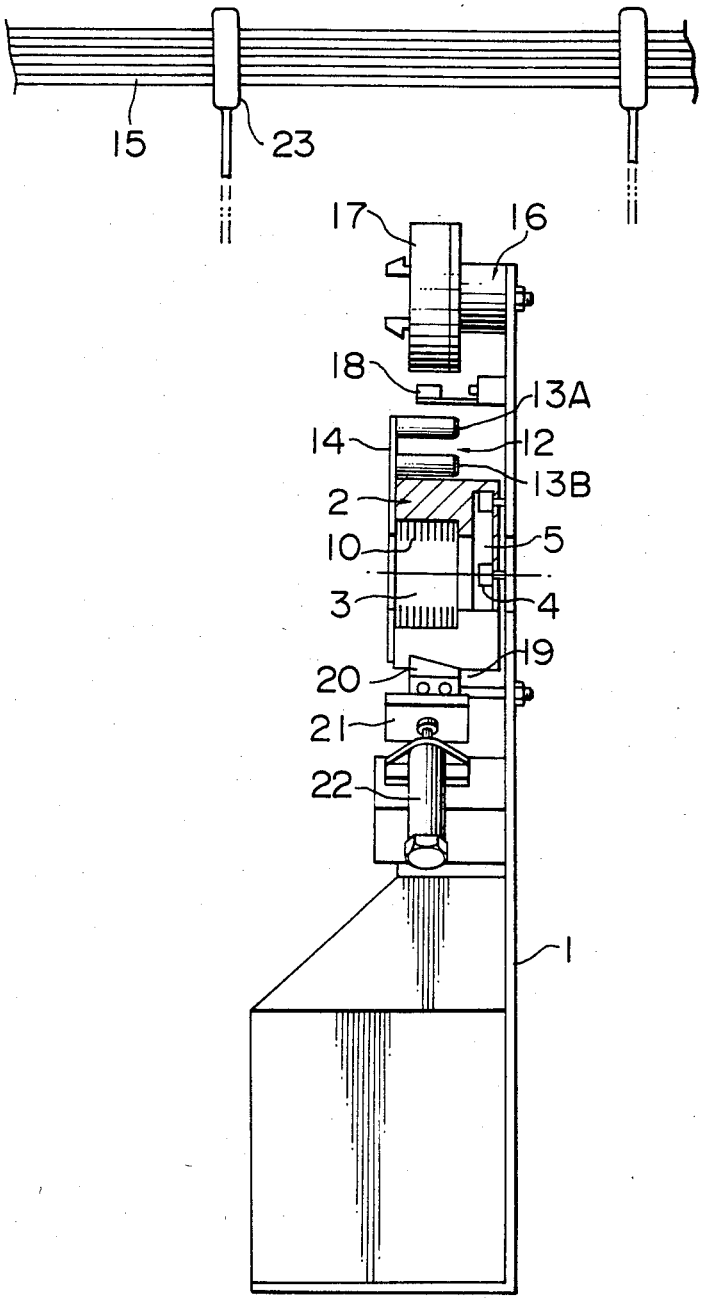
FIG. 2 is a side elevational view of the embodiment shown in FIG. 1.

Referring to FIGS. 1 and 2, an embodiment of the binding machine of the invention has a vertical frame plate 1 which carries at its one side a drum-type rotary member 2. The rotary member 2 is mounted rotatably with its one side held in contact with the surface of the frame plate 1. The rotary member 2 is recessed radially inwardly from its outer peripheral surface in a U-like form over a predetermined region of its circumference, thus forming a work holding portion 3. More specifically, a plurality of carrier rollers 4 mounted on the surface of the frame plate 1 are received in an annular groove 5 formed in the rotary member 2, so that the latter is rotatably carried by the carrier rollers 4. A driving pulley 6 and three idle pulleys 7 are disposed on the surface of the frame plate 1. A timing belt 8 goes round the driving pulley 6 and the idle pulleys 7. The timing belt 8 is held in contact with a lower portion of the rotary member 2 over a predetermined portion of the circumference thereof. The driving pulley 6 is operatively connected to the pneumatic cylinder 11 through gears 9A, 9B and a rack 9C. The arrangement is such that, when the pneumatic cylinder 11 operates to extend its rod llA upwardly, the rack 9C is moved upwardly such as to rotate the rotary member 2 clockwise, as indicated by an arrow in FIG. 1, over a predetermined angle, through the action of the gears 9B, 9A, driving pulley 6 and the timing belt 8. Conversely, a downward retraction of the rod llA causes the rotary member 2 to rotate counter-clockwise. This, however, is not exclusive and the arrangement may be modified by the use of a suitable mechanism such that the rotary member 2 rotates unidirectionally, i.e., only in the clockwise direction as indicated by the arrow A. A holding plate 14 is attached to the surface of the rotary member 2 remote from the frame plate 1. The holding plate 14 has a tape guiding portion 12 constituted by a radial projection which is formed at a position circumferentially spaced in the counter-clockwise direction from the position of the tape holding portion 3. The tape guiding portion 12 has a pair of guide pins 13A and 13B which are secured to the surface of the projection of the holding plate 14 such as to extend therefrom towards the frame plate 1 in parallel to the axis of the rotary member 2. One 13A of the pins is positioned on the distal end of the tape guiding portion 12, i.e., on the radially outer extremity of the projection of the holding plate 14, while the other 13B is located on the proximal end of the tape guiding portion 12, i.e., in the vicinity of the outer periphery of the rotary member 2.

When the rotary member 2 is stationed at a predetermined rotational position, the work holding portion 3 is aligned with a U-shaped notch formed in the frame plate 1. In this state, the rotary member receives at its work holding portion 3 a bundle 15 of wires to be bound (referred to as "work 15", hereinunder) which is inserted as indicated by an arrow B, such that the center of the work 15 substantially coincides with the center 0 of the rotary member 2. The work 15 is resiliently held in the work holding portion 3 by a brush means 10 which is provided in the work holding portion 3.

On the other hand, a tape roll holding portion 16, which is secured to the portion of the frame plate 1 above the rotary member 2, detachably and rotatably holds a roll 17 of an adhesive tape which is to be wound around the work 15. The tape roll 17 in the state held by the tape roll holding portion 16 has its axis extended in parallel with the axis of the rotary member 2. More specifically, the tape roll holding portion 16 holds the tape roll 17 such that the tape extracted from the tape roll 17 can be lead to a position in front of the radial opening of the work holding portion 3, through a tape sensor 18 which is responsive to the presence of the tape. A reference numeral 24 denotes a tape guide which is provided at the inlet of the work holding portion 3.

A tape cutting portion 19 is provided on the surface of the frame plate 1 at the lower side of the rotary member 2 in the vicinity of the work holding portion 3. The tape cutting portion 19 has a cutting blade 20 which stands upright as viewed in FIG. 1, i.e., counter to the direction of rotation of the rotary member 2 indicated by an arrow A. The tape cutting portion 19 is positioned between a pair of concentric circles which are drawn by the pair of guide pins 13A and 13B when the rotary member 2 is rotated. In other words, the tape cutting portion 19 is located between the pair of guide pins 13A and 13B when viewed in the radial direction from the center of rotation of the rotary member 2, so that the rotary member 2 can be rotated without any fear of interference between the tape guiding portion 12 and the tape cutting portion 19.

A tape retaining portion 21 is disposed at a position which is slightly downward and rightward of the tape cutting portion 19 as viewed in FIG. 1. The tape retaining portion 21 is constituted by an elastic member attached to the end of a rod of a pneumatic cylinder 22 which in turn is fixed to a bracket 1A projecting to the right from the frame plate 1 as viewed in FIG. 1. Thus, the tape retaining portion 21 is movable reciprocatingly as indicated by arrows C as the rod of the pneumatic cylinder 22 is extended and retracted. When the rod of the pneumatic cylinder 22 is fully extended, the tape retaining portion 21 is moved to the position indicated by a phantom line 21' where it resiliently contacts the guide pin 13A on the radial extremity of the tape guiding portion 12 in such a manner that the rotation of the rotary member 2 is not substantially resisted by this resilient contact.

The tape cutting portion 19 and the tape retaining portion 21 are arranged such that the tape which is being guided by the tape guiding portion 12 is cut by the tape cutting portion 19 and, at the same time, the cut end of the tape severed from the tape roll and hanging down therefrom is automatically adhered to the tape retaining portion 21' in the extended position. Then, the tape retaining portion is automatically retracted to the position 21 shown by solid lines.

The operation of this embodiment will be described hereinunder with reference to FIGS. 3A to 3D.

Figure 3A:
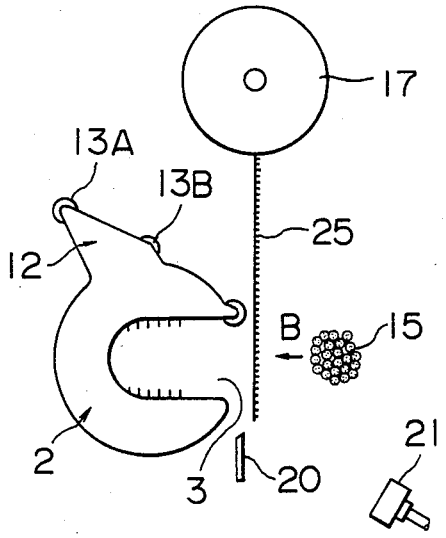
FIGS. 3A to 3D are illustrations of different steps of the operation of the embodiment shown in FIG. 1.
Figure 3B:
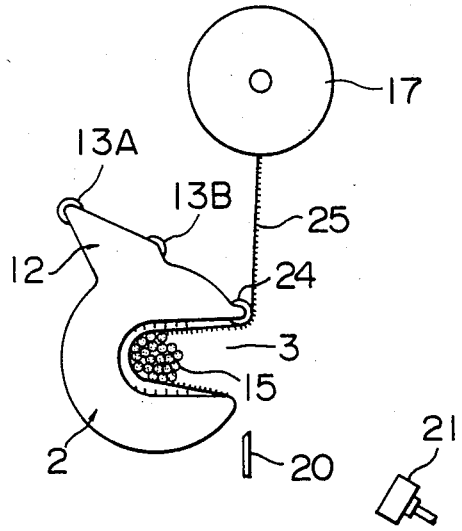

The roll 17 of the tape 25 which is to be wound on the work 15 is set on the tape roll holding portion 16, and a suitable length of the leading end of the tape 25 is extracted from the roll 17 such that the extracted portion of the tape hangs in front of the work holding portion 3 of the rotary member 2, as shown in FIG. 3A. Then, the work 15 is moved by a suitable means such as a chucking arm 23 shown in FIGS. 1 and 2 into the work holding portion 3 such that the tape 25 is pushed and pressed into the tape holding portion 3 as shown in FIG. 3B. Since the tape 25 is oriented such that its adhesive side is directed outwardly of the tape holding portion 3, the tape 25 is adhered to the work 15 over almost half of the circumference of the work 15.

Figure 3C:
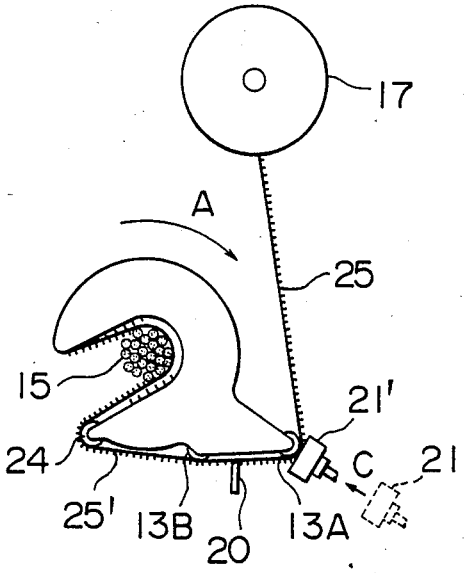

Then, the rotary member 2 is rotated clockwise as indicated by the arrow A, so that the guide pins 13A and 13B on the tape guiding portion 12 catch and extract the tape 25, as shown in FIG. 3C. The portion of the tape 25 stretched between both guide pins 13A and 13B is automatically cut by the upright cutting blade 20 of the tape cutting portion 19, when it is moved through the tape cutting portion 19. At the same time, the tape 25 which is held on the guide pin 13A is brought into contact with the tape retaining portion 21' in the extended position, so that its adhesive surface is adhered to the retaining portion 21'. Therefore, the tape 25 leading from the tape roll 17 is retained by the tape retaining portion 21', without being suspended.

Figure 3D:
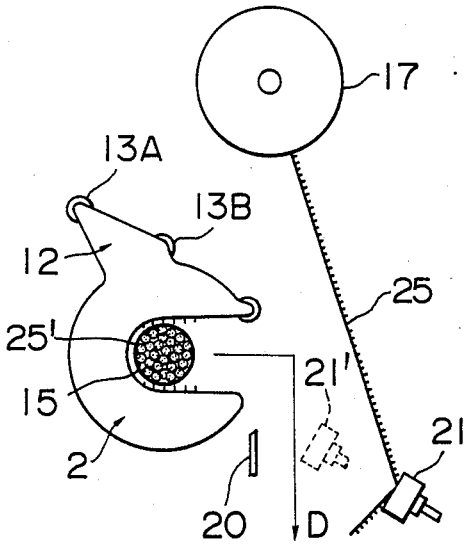

In this state, the rotary member 2 rotates two or three times, so that a severed piece 25' of the tape, having a suitable length, is wound around the work 15 held in the work holding portion 3, thus binding the work 15 as shown in FIG. 3D.

In the transient period between the state shown in FIG. 3B and the state shown in FIG. 3D, the work 15 together with the tape 25 thereon is pressed onto the brush means 10 and is fixed by the chucking arm 23 of the like means against rotation, so that the tape piece 25' is automatically wound on the work 15 as the rotary member 2 rotates.

During the final binding, the tape retaining portion 21 retaining the leading end of the tape 25 is held in the retracted position, so that the work 15 bound by the tape can be ejected from the work holding portion 3 through a gap formed between the tape retaining portion 21 and the rotary member 2, as indicated by an arrow D.

When the next binding cycle is started, the tape 25 is separated from the tape retaining portion 21 as it is pulled by virture of the friction between itself and the work 15 which occurs when the latter is moved into the work holding portion 3. The binding is then made in the same way as that explained hereinbefore.

In the described embodiment of the binding machine of the invention, the tape retaining portion 21 is provided for the purpose of temporarily retaining the free end of the tape 25 suspended from the tape roll 17, thereby smoothing the insertion and ejection of the work 15 into and out of the work holding portion 3 of the rotary member 2. This, however, is not exclusive and the tape retaining portion 21 may be omitted if the circumstances allow.

As has been described, in the binding machine of the invention, the rotary member 2 serving as a taping means has a tape guiding portion 12 projecting radially outwardly therefrom in the form of a horn. The tape guiding portion 12 has a pair of guide pins 13A and 13B for extracting the tape 25 from the tape roll 17. In addition, a tape cutting portion 19 having a cutting blade 20 standing upright against the rotation of the rotary member is disposed between two concentric circles along which the guide pins 13A and 13B move when the rotary member 2 rotates. The tape 25 is, therefore, by a single action of the rotary member 2, extracted, cut and then wound on the work 15, thus completing the binding.

As will be understood from the foregoing description, the binding machine of the invention is much smaller in size and much simpler in construction than conventional binding machines. The simplified construction in turn ensures a higher reliability of operation. The binding machine of the invention can be incorporated, for example, in an automatic line for processing electric wires, while ensuring a high production efficiency of such a line.

Although the invention has been described by means of specific terms, it is to be noted here that the described embodiment is only illustrative and various changes and modifications may be imparted thereto without departing from the scope of the invention which is limited solely by the appended claims.

What is claimed is:

1. A binding machine comprising a drum-like rotary member mounted on a frame for rotation in at least one direction, said rotary member having a notch formed over a portion of the circumference thereof and extending radially inwardly to the area around the center thereof for providing a substantially U-shaped work holding means, said rotary member further having a tape guiding portion extending radially outwardly therefrom at a position spaced from said work holding means, said tape guiding portion being provided with a pair of guide pins, one of which is located in the radially outer extremity of said tape guiding portion while the other is located near the radially inner end of said tape guiding portion, a cutting means mounted against movement on said frame and having a cutting blade disposed between two concentric circles along which said guide pins move when said rotary member rotates in said direction and directed counter to the direction of rotation of said rotary member, and a tape roll holding means mounted on said frame and adapted for holding a tape roll such that the leading end of the tape extracted therefrom is led to a position in front of the radial opening of said work holding means, whereby, when said rotary member rotates in said direction with a work received in said work holding means and partially wound by the tape extracted from said tape roll, said tape is further extracted, cut and wound around said work thus accomplishing the binding.

2. A binding machine according to claim 1, further comprising a tape retaining means mounted on said frame and positioned in the vicinity of said cutting means, said tape retaining means being resiliently contactable with said guide pin on the radially outer extremity of said tape guiding portion in such a manner as not to cause a substantial resistance to the rotation of said rotary member, whereby the leading end of said tape extracted from said tape roll is pressed and adhered by said guide pin onto said tape retaining means such as to be retained by said tape retaining means.

3. A binding machine according to claim 2, wherein said tape retaining means is retractable radially outwardly of said rotary member.

* * * * *